US010486288B2

(12) United States Patent
Watanabe

(10) Patent No.: US 10,486,288 B2
(45) Date of Patent: Nov. 26, 2019

(54) CYLINDRICAL GRINDING METHOD AND CYLINDRICAL GRINDING MACHINE

(71) Applicant: JTEKT CORPORATION, Osaka-shi (JP)

(72) Inventor: Akira Watanabe, Chiryu (JP)

(73) Assignee: JTEKT CORPORATION, Osaka-shi (JP)

( * ) Notice: Subject to any disclaimer, the term of this patent is extended or adjusted under 35 U.S.C. 154(b) by 436 days.

(21) Appl. No.: 15/200,525

(22) Filed: Jul. 1, 2016

(65) Prior Publication Data

US 2017/0008145 A1 Jan. 12, 2017

(30) Foreign Application Priority Data

Jul. 7, 2015 (JP) ..... 2015-136378

(51) Int. Cl.
*B24B 51/00* (2006.01)
*B24B 5/00* (2006.01)

(52) U.S. Cl.
CPC ..... *B24B 51/00* (2013.01); *B24B 5/00* (2013.01)

(58) Field of Classification Search
None
See application file for complete search history.

(56) References Cited

U.S. PATENT DOCUMENTS 2,932,130 A * 4/1960 Blood ..... B24B 5/06 125/11.18
4,905,417 A * 3/1990 Oda ..... B24B 51/00 451/14
2011/0097971 A1* 4/2011 Kumeno ..... B24B 5/04 451/5
2015/0343598 A1* 12/2015 Ebina ..... B24B 49/04 700/164

FOREIGN PATENT DOCUMENTS

JP 2-47164 U 3/1990
JP 2011-104675 6/2011

OTHER PUBLICATIONS

JP 2015-136378 English Trans, attached as pdf.*
Office Action dated Mar. 26, 2019 in the corresponding Japanese Patent Application No. 2015-136378 Unedited Computer-Generated English Translation only citing document AO therein 3 pages.
Office Action dated Mar. 26, 2019 in the corresponding Japanese Patent Application No. 2015-136378 Unedited Computer-Generated English Translation 3 pages.

* cited by examiner

*Primary Examiner* — Brian D Keller
(74) *Attorney, Agent, or Firm* — Oblon, McClelland, Maier & Neustadt, L.L.P.

(57) ABSTRACT

In a cylindrical grinding method, rough grinding is performed until a diameter of a workpiece reaches a rough-grinding setting value, and then, first finish grinding is performed until the diameter of the workpiece reaches a first (Continued)

finish setting value while measuring a shape deviation amount of an outer peripheral surface of the workpiece from a perfect round shape. The rough-grinding setting value in the next-time rough grinding step is changed based on a necessary time of the first finish grinding step to time at which the shape deviation amount reaches a first threshold or smaller in the first finish grinding step, and based on a total required time for the first finish grinding step.

18 Claims, 4 Drawing Sheets

CYLINDRICAL GRINDING METHOD AND CYLINDRICAL GRINDING MACHINE

INCORPORATION BY REFERENCE

The disclosure of Japanese Patent Application No. 2015-136378 filed on Jul. 7, 2015 including the specification, drawings and abstract, is incorporated herein by reference in its entirety.

BACKGROUND OF THE INVENTION

1. Field of the Invention

The present invention relates to a cylindrical grinding method and a cylindrical grinding machine.

2. Description of Related Art

Japanese Patent Application Publication No. 2011-104675 describes a method for grinding a cylindrical workpiece. In this grinding method, rough grinding is first performed, precision grinding as a finish grinding step is subsequently performed after the diameter of the workpiece reaches D1, and fine grinding as another finish grinding step is performed after the diameter of the workpiece reaches D2. The timing for switching from the rough grinding to the precision grinding and the timing for switching from the precision grinding to the fine grinding are determined based on measurement values obtained by a sizing device for measuring the outer diameter of the workpiece.

The rough grinding is performed at a high grinding efficiency, and therefore generates a shape deviation from a perfect round shape. The workpiece is, however, ground in the finish grinding step as a post-process so as to reduce the amount of shape deviation from a perfect round shape to a value within a predetermined range. The timing for switching from the rough grinding to the finish grinding is set so as to reduce the amount of shape deviation to a value within a predetermined range. The diameter of the workpiece corresponding to the timing for switching from the rough grinding to the finish grinding is set in advance.

The grinding wheel is subjected to truing at appropriate times because the grinding wheel changes in grinding performance and clogging state. Therefore, the diameter of the workpiece at which the finish grinding is to start is set taking into account the change in the grinding performance and the change in the clogging state of the grinding wheel.

For example, the grinding wheel has good grinding performance and has almost no clogging immediately after the truing. Therefore, immediately after the truing, the shape deviation can be eliminated in a relatively short time since the switching to the finish grinding. After many workpieces are ground since the truing of the grinding wheel, the grinding performance of the grinding wheel degrades, and the grinding wheel is clogged. Therefore, in the state after many workpieces are ground since the truing of the grinding wheel, the shape deviation can be eliminated after a relatively long time has elapsed since the switching to the finish grinding.

As described above, the diameter of the workpiece corresponding to the timing for switching from the rough grinding to the finish grinding is a value set in advance, and hence is set to a value with which the shape deviation can be eliminated in the state after many workpieces are ground since the truing of the grinding wheel. Due to this, depending on circumstances, cases occur where the finish grinding is performed for an unnecessarily long time.

SUMMARY OF THE INVENTION

It is an object of the present invention to provide a cylindrical grinding method and a cylindrical grinding machine that can reduce a total time of grinding by setting the time for performing finish grinding to a necessary and sufficient time.

According to an aspect of the present invention, a cylindrical grinding method is provided for grinding a cylindrical workpiece with a grinding wheel. The cylindrical grinding method includes performing rough grinding until a diameter of the workpiece reaches a rough-grinding setting value, and performing finish grinding subsequently to the rough grinding until the diameter of the workpiece reaches a finish setting value while measuring a shape deviation amount of the workpiece from a perfect round shape in one rotation of an outer peripheral surface of the workpiece. The rough-grinding setting value in the rough grinding at a next time is changed based on a necessary time from start time of the finish grinding to time at which the shape deviation amount in the finish grinding, and based on a total required time for the finish grinding.

Changing the rough-grinding setting value changes timing for switching from the rough grinding to the finish grinding. For example, changing the rough-grinding setting value to a smaller value delays the timing for switching from the rough grinding to the finish grinding, and, as a result, reduces the amount of grinding obtained by the finish grinding. This reduces the time for grinding as a whole. By contrast, changing the rough-grinding setting value to a larger value advances the timing for switching from the rough grinding to the finish grinding, and, as a result, increases the amount of grinding obtained by the finish grinding. This increases the time for grinding as a whole.

The rough-grinding setting value in the rough grinding at the next time is changed based on the necessary time from the start time of the finish grinding to the time at which the shape deviation amount reaches the threshold or smaller in the finish grinding at the current time, and based on the total required time for the finish grinding. A state where the necessary time is sufficiently shorter than the total required time refers to, for example, a state where the grinding wheel has good grinding performance and the shape deviation amount is eliminated at early time in the finish grinding. In such a case, it is preferable that the rough-grinding setting value at the next time be changed to a smaller value.

By changing the next-time rough-grinding setting value based on the necessary time and the total required time in this manner, the timing for switching from the rough grinding to the first finish grinding can be appropriate timing in accordance with the property of the grinding wheel. That is, the time for performing the finish grinding results in a necessary and sufficient length of time. As a result, the total time of the grinding decreases in the case of grinding a plurality of such workpieces.

According to another aspect of the present invention, a cylindrical grinding machine includes a spindle device that supports a cylindrical workpiece such that the cylindrical workpiece is rotatable, a grinding wheel that grinds the workpiece, a measuring device that measures a shape deviation amount of the workpiece from a perfect round shape in one rotation of an outer peripheral surface of the workpiece, and a control device that controls the cylindrical grinding machine so as to perform rough grinding until a diameter of the workpiece reaches a rough-grinding setting value, and to perform finish grinding subsequently to the rough grinding until the diameter of the workpiece reaches a finish setting value while measuring the shape deviation amount of the workpiece. The cylindrical grinding machine provides the same effect as that provided by the cylindrical grinding method described above.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENT

The following describes a grinding wheel head traverse type cylindrical grinding machine as an example of the cylindrical grinding machine 1. A crankshaft is exemplified as a workpiece W to be ground by the cylindrical grinding machine 1, and a grinding target portion of the workpiece W is assumed to be a crank pin Wa or a journal Wb that has a cylindrical surface. The crank pin Wa and the journal Wb are provided with recesses, such as oil holes (not shown). For example, the oil holes are formed in a radially penetrating manner.

Figure 1:
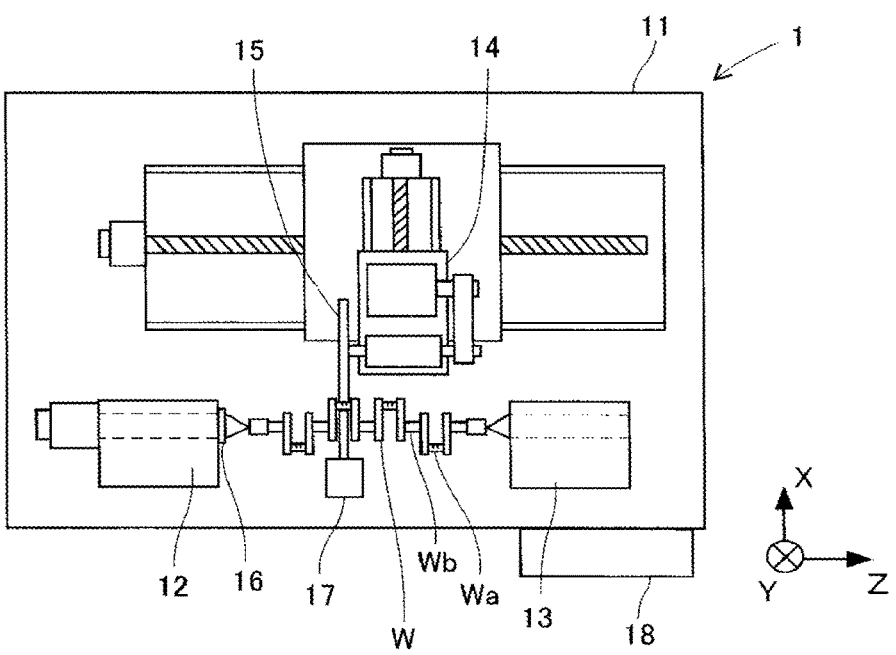
FIG. 1 is a plan view of a grinding machine in an embodiment of the present invention.

The cylindrical grinding machine 1 will be described with reference to FIG. 1. The cylindrical grinding machine 1 is structured in the following manner. A bed 11 is fixed on a floor. A spindle device 12 and a tailstock device 13 to support both ends of the workpiece W such that the workpiece is rotatable are mounted on the bed 11. The workpiece W is supported by the spindle device 12 and the tailstock device 13 so as to be rotate about the journal Wb. This means that the crank pin Wa revolves so as to form a circular trajectory the center of which is offset from the center of the revolution of the rotating workpiece W.

The bed 11 mounts thereon a grinding wheel head 14 that is movable in the Z-axis direction (axial direction of the workpiece W) and in the X-axis direction (direction orthogonal to the axial line of the workpiece W). The grinding wheel head 14 is provided with a grinding wheel 15 rotatably supported thereon, and a coolant nozzle (not shown) for supplying a coolant toward a grinding point. The spindle device 12 is provided with an AE sensor 16 (corresponding to a measuring device or a grinding resistance detector) for measuring an X-axis direction component of a grinding resistance (grinding resistance in the infeed direction) applied to the spindle device 12. The AE sensor 16 may, however, be directly in contact with the grinding target portion of the workpiece W so as to measure the X-axis direction component of the grinding resistance. The bed 11 is also provided with a sizing device 17 for measuring the diameter of the workpiece W. The cylindrical grinding machine 1 is further provided with a control device (controller) 18 for rotating the spindle device 12 and the grinding wheel 15, and for controlling the position of the grinding wheel 15 with respect to the workpiece W.

Figure 2:
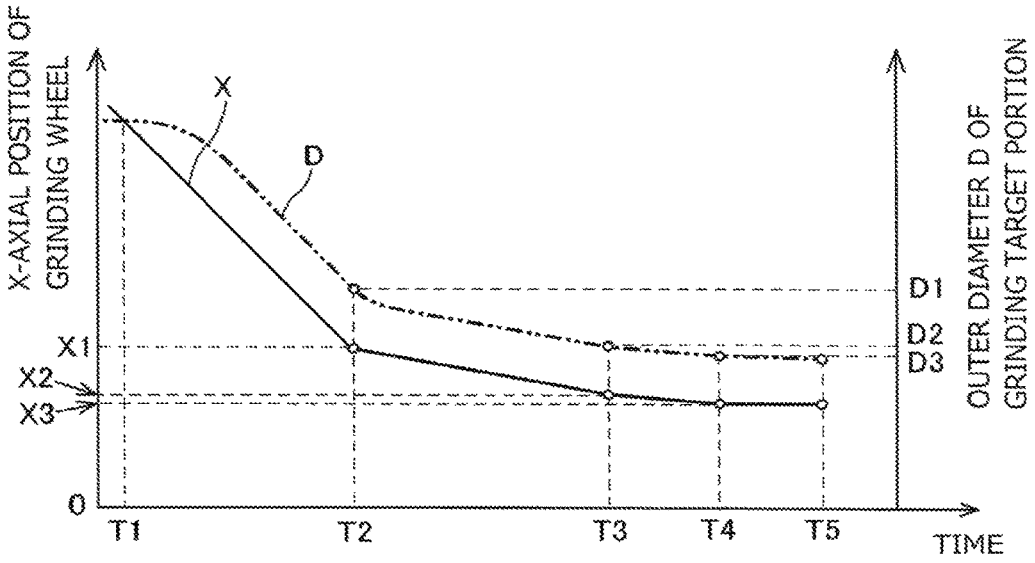
FIG. 2 is a graph showing temporal changes in an X-axis position of a grinding wheel and an outer diameter of a workpiece.
Figure 3:
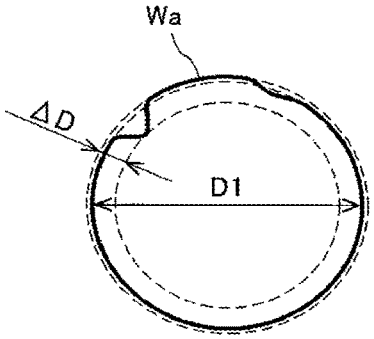
FIG. 3 is a view showing a sectional shape of the workpiece after rough grinding, the view showing an amount of deviation from a perfect round shape in an exaggerated manner.

The following describes a method for grinding the workpiece W with reference to FIGS. 2 and 3. In the present embodiment, rough grinding, first finish grinding (precision grinding), second finish grinding (fine grinding), and spark-out are performed in this order. The coolant is always supplied in these steps.

First, the control device 18 advances the grinding wheel 15 in the X-axis direction relative to the workpiece W so as to start the rough grinding (rough grinding step) (from T1 to T2 in FIG. 2). In the rough grinding, the grinding wheel 15 advances in the negative X-axis direction at a constant speed, as shown from T1 to T2 in FIG. 2. In other words, in the rough grinding, the grinding wheel 15 makes a relative movement in the direction to be pressed to the workpiece W. In the rough grinding, the moving speed is made larger than that of the first finish grinding to obtain a higher grinding efficiency (amount of grinding per unit time per unit width). That is, the amount of change per time in the X-axis position of the grinding wheel 15 is larger during the time from T1 to T2 in FIG. 2. During the rough grinding in FIG. 2, coolant dynamic pressure and the grinding resistance act on the workpiece W, and the workpiece W deflects in the infeed direction.

While the rough grinding is performed, a determination is made as to whether an outer diameter D (hereinafter called the workpiece outer diameter) of the grinding target portion of the workpiece W measured by the sizing device 17 reaches a rough-grinding setting value D1 set in advance. When the workpiece outer diameter D reaches the rough-grinding setting value D1, the processing is switched from the rough grinding step to the first finish grinding step (from T2 to T3 in FIG. 2). When the workpiece outer diameter D reaches the rough-grinding setting value D1, the X-axis position of the grinding wheel 15 is X1.

When the rough grinding is completed, the outer peripheral surface of the grinding target portion of the workpiece W has a shape schematically shown in FIG. 3. That is, the outer peripheral surface shape of the grinding target portion of the workpiece W is not a perfect round shape and has a shape deviation from a perfect round shape. If the crank pin Wa is the grinding target portion, a reason for the shape deviation is that the distance between the grinding point and the position supplied with the coolant changes in accordance with the rotational phase of the workpiece W. Moreover, if the grinding target portion of the workpiece W is provided with an oil hole, another reason for the shape deviation is that a rapid decrease in the coolant dynamic pressure during grinding in the vicinity of the oil hole reduces the amount of deflection of the workpiece W. In particular, in the rough grinding, a large amount of coolant is supplied to increase the grinding efficiency, and the change in the coolant dynamic pressure accordingly increases. As described above, the rough grinding step is a grinding step that allows the outer peripheral surface shape of the grinding target portion of the workpiece W to have the shape deviation from a perfect round shape.

In the first finish grinding step, the control device 18 controls the cylindrical grinding machine to advance the grinding wheel 15 (move the grinding wheel 15 in the negative X-axis direction) relative to the workpiece W so as to perform the first finish grinding. In the first finish grinding, the amount of supply of the coolant is reduced to reduce the influence of change in the coolant dynamic pressure. Hence, the grinding accuracy can be prevented from being adversely affected by the oil hole. Moreover, the first finish grinding is performed so as to eliminate the shape deviation from a perfect round shape generated in the rough grinding. Specifically, the first finish grinding is performed so that a shape deviation amount ΔD from a perfect round shape in one rotation of the workpiece W shown in FIG. 3 falls within a threshold at the end of the first finish grinding. In addition, in the first finish grinding, the moving speed (infeed rate) of the grinding wheel 15 is set lower than that of the rough grinding, as shown in FIG. 2. As a result, in the first finish grinding, the workpiece W can be prevented from having grinding burn even though the amount of supply of the coolant is reduced.

While the first finish grinding is performed, a determination is made as to whether the workpiece outer diameter D measured by the sizing device 17 reaches a first finish setting value D2. When the workpiece outer diameter D reaches the first finish setting value D2, the processing is switched from the first finish grinding step to the second finish grinding step (from T3 to T4 in FIG. 2). When the workpiece outer diameter D reaches the first finish setting value D2, the X-axis position of the grinding wheel 15 is X2.

In the second finish grinding step, the control device 18 advances the grinding wheel 15 relative to the workpiece W so as to perform the second finish grinding. In the second finish grinding, the moving speed (infeed rate) of the grinding wheel 15 is set lower than that of the first finish grinding, as shown in FIG. 2.

While the second finish grinding is performed, a determination is made as to whether the workpiece outer diameter D measured by the sizing device 17 reaches a second finish setting value D3. When the workpiece outer diameter D reaches the second finish setting value D3, the processing is switched from the second finish grinding step to the spark-out step (from T4 to T5 in FIG. 2). The spark-out is performed in the state where the infeed amount of the grinding wheel 15 is set to zero relative to the workpiece W. That is, portions left unground in the second finish grinding are ground in the spark-out. The spark-out is performed by rotating the workpiece W by the number of rotations set in advance.

Figure 4:
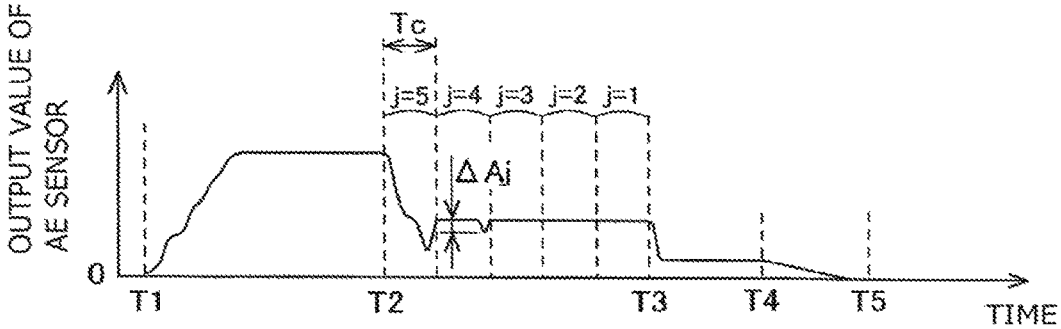
FIG. 4 is a diagram showing a temporal change in an output value of an AE sensor.

The AE sensor 16 measures a change in the X-axis direction component of the grinding resistance in the first finish grinding step. The output value of the AE sensor 16 is, for example, as shown in FIG. 4. The output value of the AE sensor 16 rapidly increases when the rough grinding (from T1 to T2) starts, and then continues to be constant. After the step is subsequently switched to the first finish grinding (from T2 to T3), the grinding resistance decreases, and the output value of the AE sensor 16 also decreases. At the initial stage of the first finish grinding, the shape deviation from a perfect round shape is present in the roughly ground portion of the workpiece W, therefore the output value of the AE sensor 16 greatly changes corresponding to the shape deviation amount ΔD from a perfect round shape in one rotation of the outer peripheral surface of the workpiece W. The shape deviation amount ΔD decreases as the first finish grinding continues, and then the output value of the AE sensor 16 also decreases. At the final stage of the first finish grinding step, the output value of the AE sensor 16 continues to be constant.

In FIG. 4, a character j represents the number of rotations of the workpiece W in the first finish grinding as counted backward from the time of the end of the first finish grinding. In FIG. 4, the first finish grinding is performed while the workpiece W makes five rotations. Therefore, the state where j=4, for example, refers to the number of rotations counted from the time of the end of the first finish grinding, and means that the workpiece W is in the second rotation.

When the step is subsequently switched to the second finish grinding, the grinding resistance further decreases, so that the output value of the AE sensor 16 also decreases. At this time, the shape deviation amount ΔD from a perfect round shape in one rotation of the workpiece W is already so small that the output value of the AE sensor 16 continues to be constant. Lastly, the grinding resistance decreases to zero during the process of performing the spark-out step, and the output value of the AE sensor 16 also decreases to zero.

The AE sensor 16 measures the grinding resistance as described above. As shown in FIG. 4, the shape deviation that was present at the initial stage of the first finish grinding step has almost been eliminated at the time of the end thereof. In the first finish grinding step, the amount of change in the grinding resistance corresponds to the shape deviation amount ΔD from a perfect round shape in one rotation of the outer peripheral surface of the workpiece W. Specifically, a difference (hereinafter called the sensor output difference) ΔAj between the maximum value and the minimum value of the output values of the AE sensor 16 corresponds to the shape deviation amount ΔD from a perfect round shape in one rotation of the outer peripheral surface of the workpiece W. In FIG. 4, the sensor output difference ΔAj represents the difference between the maximum value and the minimum value of the output values of the AE sensor 16 at the second rotation (j=4) of the workpiece W in the first finish grinding step. Accordingly, in the present embodiment, the AE sensor 16 serving as a grinding resistance detector corresponds to a measuring device for measuring the amount of change in the grinding resistance as the shape deviation amount ΔD from a perfect round shape in one rotation of the outer peripheral surface of the workpiece W in the first finish grinding step. As shown in FIG. 4, in the first finish grinding step, rotating the workpiece W by one rotation requires a time Tc.

The control device 18 performs a determination process of the rough-grinding setting value D1, in addition to controlling the grinding steps described above. The following describes, with reference to FIGS. 5 to 8, a method used by the control device 18 to determine the rough-grinding setting value D1 and the grinding method before and after the rough-grinding setting value D1 is changed. The determination process of the rough-grinding setting value D1 is a process to determine the rough-grinding setting value D1 in the following manner. On the assumption that a plurality of such workpieces W are to be ground, the rough-grinding setting value D1 to be used when a workpiece W is ground next time is determined based on the state of a workpiece W that has been ground at the current time in the first finish grinding.

As described with reference to FIG. 2, when the result of measurement by the sizing device 17 reaches the rough-grinding setting value D1, the control device 18 switches the processing from the rough grinding to the first finish grinding. In the present embodiment, the control device 18 determines the rough-grinding setting value D1(*i*+1) to be used when a workpiece W is ground next time based on the state of the workpiece W that has been ground at the current time in the first finish grinding, and thereby changes the timing for switching from the rough grinding to the first finish grinding.

First, the grinding method using the rough-grinding setting value D1(*i*) before being changed will be described with reference to FIGS. 5 and 6. For example, the rough-grinding setting value D1(*i*) before being changed is assumed to be used in the grinding of the workpiece W immediately after the grinding wheel 15 is trued.

Figure 5:
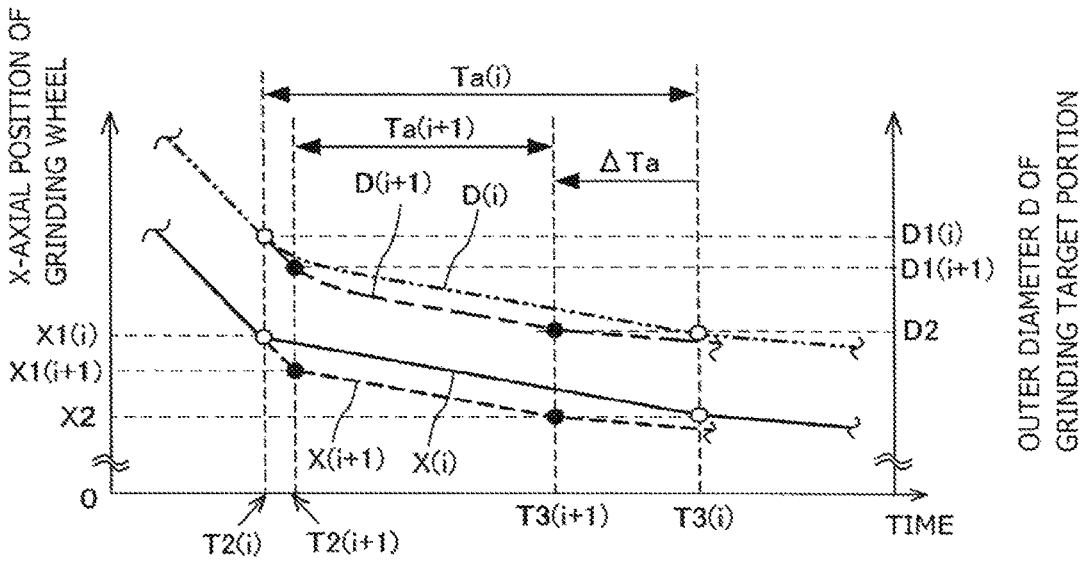
FIG. 5 shows the temporal changes in the X-axis position of the grinding wheel and the outer diameter of the workpiece during a process from an intermediate stage of the rough grinding to an intermediate stage of second finish grinding (fine grinding), showing cases of two different kinds of timing for switching from the rough grinding to first finish grinding.

As indicated by a continuous line in FIG. 5, the X-axis position X(i) of the grinding wheel 15 is X1(*i*) at rough grinding end time T2(*i*), and is X2 at first finish grinding end time T3(*i*). As indicated by a chain double-dashed line having shorter dashes in FIG. 5, the outer diameter D(i) of the grinding target portion of the workpiece W is D1(*i*) at rough grinding end time T2(*i*), and is D2 at the first finish grinding end time T3 (*i*).

Figure 6:
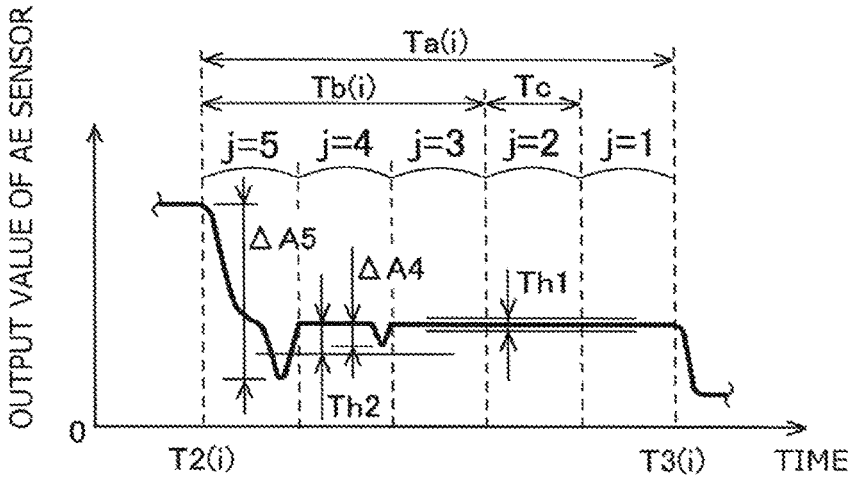
FIG. 6 shows the output value of the AE sensor in the case of earlier timing for the switching from the intermediate stage of the rough grinding to the first finish grinding in FIG. 5.

During this period, the output value of the AE sensor 16 changes as shown in FIG. 6. Assuming that the time is immediately after the grinding wheel 15 is trued, the grinding wheel 15 has good grinding performance and has almost no clogging. As a result, if the shape deviation from a perfect round shape is present on the workpiece W when the first finish grinding starts, the sensor output difference ΔAj (corresponding to the shape deviation amount ΔD) quickly decreases.

Specifically, as shown in FIG. 6, sensor output differences ΔA5 and ΔA4 are greater than a first threshold Th1 until the workpiece W is ground by two rotations (j=5 and 4) after the rough grinding has been switched to the first finish grinding at time T2(*i*). A sensor output difference ΔA3 (not shown) is already equal to or smaller than the first threshold Th1 by the time when the workpiece W has been ground by three rotations (j=3). In rotations thereafter (j=2 and 1), sensor output differences ΔA2 and ΔA1 are naturally equal to or smaller than the first threshold Th1. The first threshold Th1 corresponds to the maximum value of the shape deviation amount ΔD to be satisfied after the end of the first finish grinding.

As shown in FIG. 5, in the grinding method using the rough-grinding setting value D1(*i*) before being changed, the first finish grinding step requires a time (hereinafter called the total required time) Ta(i). As shown in FIG. 6, after the first finish grinding end time T3(*i*), the first finish grinding for three rotations of the workpiece W is performed in the state where the sensor output difference ΔAj is equal to or smaller than the first threshold Th1. This means that a smaller number of rotations suffice to perform the first finish grinding.

Figure 7:
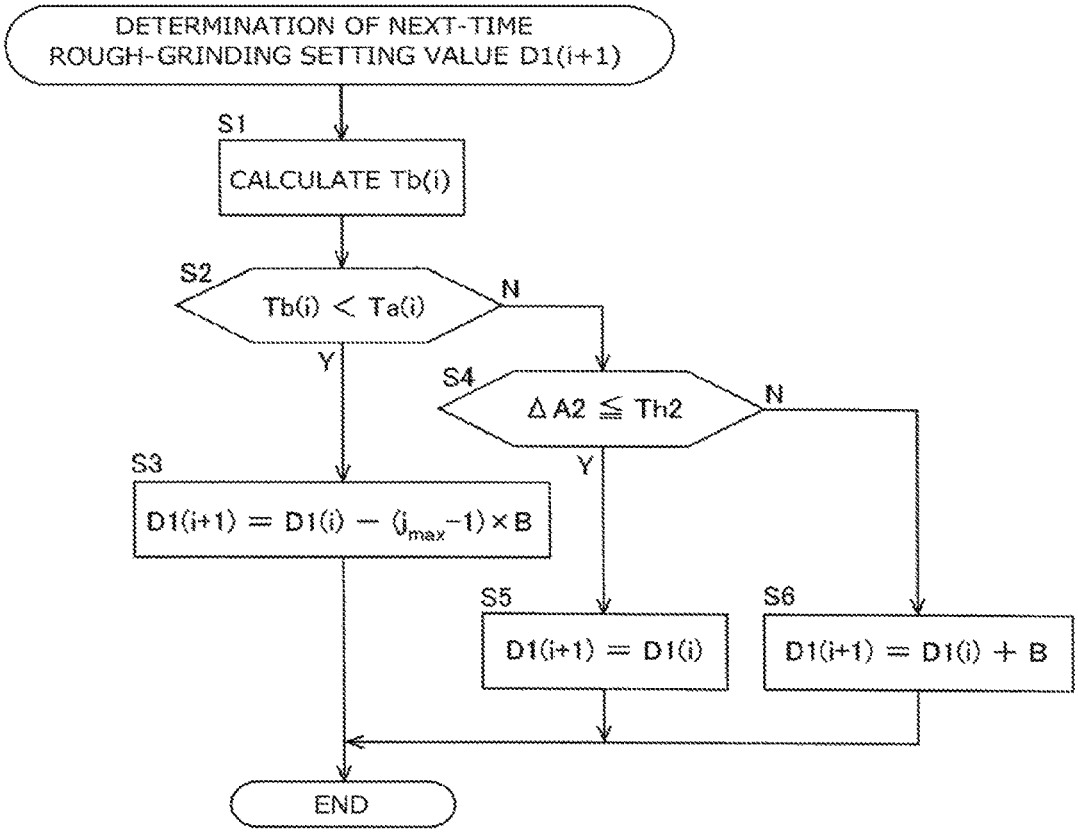
FIG. 7 is a flowchart showing a determination process of a rough-grinding setting value performed by a control device.

On the assumption that, in the state described above, the control device 18 performs the determination process of the rough-grinding setting value D1(*i*+1) for the next-time grinding of the workpiece W, this process will be described with reference to FIGS. 5, 6, and 8 in addition to the flowchart of FIG. 7. As shown in FIG. 7, the control device 18 calculates a necessary time Tb(i) from start time T2(*i*) of the first finish grinding step to end time of rotations satisfying "ΔAj≤Th1" (S1). The sensor output difference ΔAj is a value in the rotation j in the current-time first finish grinding, as shown in FIG. 6.

In the current-time first finish grinding, the sensor output differences ΔA5 and ΔA4 are greater than the first threshold Th1, and the sensor output differences ΔA3, ΔA2, and ΔA1 are equal to or smaller than the first threshold Th1, as shown in FIG. 6. In this case, the necessary time Tb(i) corresponds to a time required to rotate the workpiece W by three rotations (Tc×3).

The control device 18 subsequently determines whether "Tb(i)<Ta(i)" is satisfied (S2). In other words, the control device 18 determines whether the necessary time Tb(i) is shorter than the total required time Ta(i) of the first finish grinding step. As shown in FIG. 6, in the current-time first finish grinding, the necessary time Tb(i) is shorter than the total required time Ta(i) by a time required to rotate the workpiece W by two rotations (Tc×2), therefore the above condition is satisfied.

If the condition at S2 is satisfied (Y at S2), the control device 18 calculates the next-time rough-grinding setting value D1(*i*+1) based on an expression "D1(*i*+1)=D1(*i*)−($j_{max}$−1)×B" (S3). In the expression, D1(*i*+1) is the next-time rough-grinding setting value for switching from the rough grinding to the first finish grinding; D1(*i*) is the current-time rough-grinding setting value; and $j_{max}$ is the maximum value of the rotation j satisfying the condition that the sensor output difference ΔAj is equal to or smaller the first threshold Th1. For example, in FIG. 6, the condition that ΔAj≤Th1 is satisfied when j=3, 2, and 1. Hence, $j_{max}$ is 3 in this case. B corresponds to the infeed amount (amount of grinding) in the case of performing the first finish grinding of the workpiece W by one rotation. For example, $j_{max}$ is 3 in FIG. 6, consequently, the next-time rough-grinding setting value D1(*i*+1) is smaller than the current-time rough-grinding setting value D1(*i*) by an amount corresponding to the infeed amount (2×B) for two rotations of the first finish grinding, in this case.

Accordingly, the next-time rough-grinding setting value D1(*i*+1) results in "D(i)−2×B". That is, the next-time rough-grinding setting value D1(*i*+1) is reduced from D1(*i*) by an infeed amount for two rotations of the current-time first finish grinding of the workpiece W.

The following describes, with reference to FIGS. 5 to 8, the grinding method using the next-time rough-grinding setting value D1(*i*+1) thus determined. As indicated by a dashed line in FIG. 5, the X-axis position X(i+1) of the grinding wheel 15 is X1(*i*+1) at rough grinding end time T2(*i*+1), and is X2 at first finish grinding end time T3(*i*+1). As indicated by a chain double-dashed line having longer dashes in FIG. 5, the outer diameter D(i+1) of the grinding target portion of the workpiece W is D1(*i*+1) at the rough grinding end time T2(*i*+1), and is D2 at the first finish grinding end time T3(*i*+1).

Figure 8:
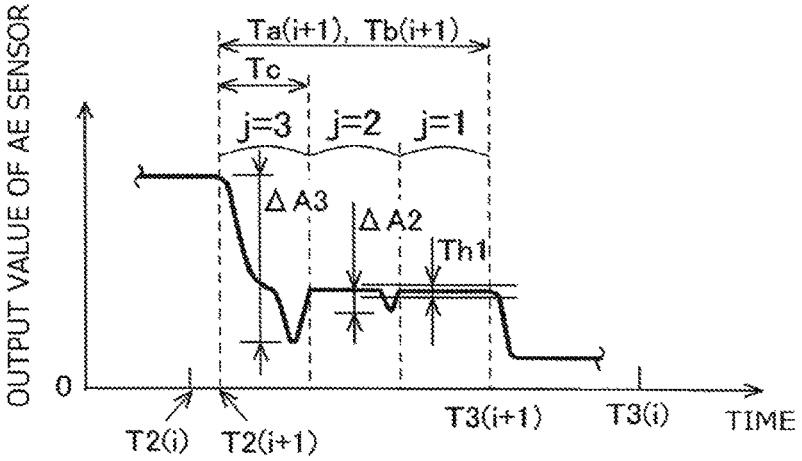
FIG. 8 shows the output value of the AE sensor in the case of later timing for the switching from the intermediate stage of the rough grinding to the first finish grinding in FIG. 6.

During this period, the output value of the AE sensor 16 changes as shown in FIG. 8. Since the number of the workpieces W ground after the grinding wheel 15 is trued is small, the grinding wheel 15 has good grinding performance and has almost no clogging. As a result, if the shape deviation from a perfect round shape is present on the workpiece W when the first finish grinding starts, the shape deviation amount quickly can decrease in the same manner as in the case of FIG. 6.

Specifically, as shown in FIG. 8, sensor output differences ΔA3 and ΔA2 are greater than the first threshold Th1 until the workpiece W is ground by two rotations (j=3 and 2) after the rough grinding has been switched to the first finish grinding at time T2(*i*+1), but the sensor output difference ΔA1 (not shown) is equal to or smaller than the first threshold Th1 by the time when the workpiece W has been ground by three rotations (j=1). The final rotation for the first finish grinding is completed when workpiece W has been ground by three rotations. Accordingly, the total required time Ta(i+1) for the first finish grinding is equal to the necessary time Tb(i+1).

As shown in FIG. 5, in the grinding method using the rough-grinding setting value D1(*i*+1) after being changed, the first finish grinding step requires the total required time Ta(i+1). After the rough-grinding setting value D1 is changed, the timing for switching from the rough grinding to the first finish grinding is delayed compared with that before the change. However, the timing for ending the first finish grinding is advanced by a time ΔTa. When the first finish grinding is completed, the outer diameter of the workpiece W has reached the first finish setting value D2, and the sensor output difference ΔAj (shape deviation amount ΔD from a perfect round shape) in one rotation of the outer peripheral surface of the workpiece W is equal to or smaller than the first threshold Th1.

Referring back to FIG. 7, the description of the processing by the control device 18 will be continued. If the condition at S2 is not satisfied (N at S2), the control device 18 determines whether "ΔA2≤Th2" is satisfied (S4). ΔA2 represents the sensor output difference in the second final rotation in the current-time first finish grinding. A second threshold Th2 is a higher value than the first threshold Th1 (refer to FIGS. 6 and 8). The second threshold Th2 is set to such a value that allows the sensor output difference ΔAj to reach the first threshold Th1 or smaller after the first finish grinding is performed by one more rotation.

For example, if the sensor output difference ΔAj in the first finish grinding is as shown in FIG. 8, the condition at S4 is satisfied. As shown in FIG. 8, the sensor output difference ΔA2 in the second final rotation for the first finish grinding is equal to or smaller than the second threshold Th2, and the sensor output difference ΔA1 in the final rotation is equal to or smaller than the first threshold Th1. If the condition at S4 is satisfied (Y at S4), the control device 18 sets the next-time rough-grinding setting value D1(*i*+1) to the same value as the current-time rough-grinding setting value D1(*i*) (S5). In other words, the timing for switching to the first finish grinding at the next time is the same as that at the current time.

If the condition at S4 is not satisfied (N at S4), the control device 18 calculates the next-time rough-grinding setting value D1(*i*+1) based on an expression "D1(*i*+1)=D1(*i*)+B" (S6). If the condition at S4 is not satisfied, the sensor output difference ΔA2 in the second final rotation in the first finish grinding is greater than the second threshold Th2.

For example, grinding a large number of the workpieces W after truing degrades the grinding performance of the grinding wheel 15 and causes the clogging thereof. In such a case, the sensor output difference ΔA2 in the second final rotation in the first finish grinding may be greater than the second threshold Th2. In that case, the next-time rough-grinding setting value D1(*i*+1) is set greater than the current-time rough-grinding setting value D1(*i*) by an amount corresponding to the infeed amount (B) for one rotation in the first finish grinding. In other words, compared with the current-time first finish grinding, the next-time first finish grinding performs an extra one rotation of the outer peripheral surface of the workpiece W.

Due to this, even if the grinding performance of the grinding wheel 15 further degrades in the next-time grinding of the workpiece W, the sensor output difference ΔA1 can be surely equal to or smaller than the first threshold Th1 at the time of the end of the first finish grinding.

In the cylindrical grinding machine 1 described above, the AE sensor 16 as a grinding resistance detector serves as a measuring device for measuring the shape deviation amount ΔD from a perfect round shape in one rotation of the outer peripheral surface of the workpiece W. Specifically, the difference ΔAj between the maximum value and the minimum value of the grinding resistance measured as the output values of the AE sensor 16 while the workpiece W makes one rotation represents the shape deviation amount ΔD.

Alternatively, the cylindrical grinding machine 1 can use the sizing device 17 for measuring the shape of the outer peripheral surface of the workpiece W as a measuring device for measuring the shape deviation amount ΔD. In this case, the amount of change in the outer diameter of the shape of the outer peripheral surface of the workpiece W measured by the sizing device 17 while the workpiece W makes one rotation represents the shape deviation amount ΔD. Also, in the case where the sizing device 17 measures the shape deviation amount ΔD as described above, substantially the same processing is performed and the same effect is obtained as in the above-described case where the AE sensor 16 measures the sensor output difference ΔAj corresponding to the shape deviation amount ΔD. In this case, the cylindrical grinding machine 1 need not include the AE sensor 16.

The cylindrical grinding method performed by the cylindrical grinding machine 1 of the present embodiment is a method of grinding the cylindrical workpiece W with the grinding wheel 15. The cylindrical grinding method includes the rough grinding step (from T1 to T2) of performing the rough grinding until the diameter of the workpiece W reaches the rough-grinding setting value D1, and also includes, subsequently to the rough grinding, the first finish grinding step (from T2 to T3) of performing the first finish grinding until the diameter of the workpiece W reaches the first finish setting value D2 while measuring the shape deviation amount ΔD (ΔAj) of the workpiece W from a perfect round shape in one rotation of the outer peripheral surface of the workpiece W. In the cylindrical grinding method, the rough-grinding setting value D1 in the next-time rough grinding step (from T1 to T2(*i*+1)) is changed based on the necessary time Tb(i) from the start time T2(*i*) of the first finish grinding step to the time at which the shape deviation amount ΔD (ΔAj) reaches the first threshold Th1 or smaller in the first finish grinding step (from T2(*i*) to T3(*i*)), and based on the total required time Ta(i) for the first finish grinding step.

Changing the rough-grinding setting value D1 changes the timing for switching from the rough grinding to the first finish grinding. For example, changing the rough-grinding setting value D1 to a smaller value delays the timing for switching from the rough grinding to the first finish grinding, and, as a result, reduces the amount of grinding obtained by the first finish grinding. This reduces the time for grinding as a whole. By contrast, changing the rough-grinding setting value D1 to a larger value advances the timing for switching from the rough grinding to the first finish grinding, and, as a result, increases the amount of grinding obtained by the first finish grinding. This increases the time for grinding as a whole.

The rough-grinding setting value D1(*i*+1) in the next-time rough grinding step (from T1 to T2(*i*+1)) is changed based on the necessary time Tb(i) from the start time T2(*i*) of the first finish grinding to the time at which the shape deviation amount ΔD (ΔAj) reaches the first threshold Th1 or smaller in the current-time first finish grinding step (from T2(*i*) to T3(*i*)), and based on the total required time Ta(i) for the first finish grinding step. A state where the necessary time Tb(i) is sufficiently shorter than the total required time Ta(i) refers to, for example, a state where the grinding wheel 15 has good grinding performance and therefore the shape deviation amount ΔD (ΔAj) is eliminated at early time in the first finish grinding step, that is, for example, a state where the necessary time Tb(i) is shorter than the total required time Ta(i) by at least the time Tc required to rotate the workpiece W by one rotation. In such a case, it is preferable that the next-time rough-grinding setting value D1(*i*+1) be changed to a smaller value.

By changing the next-time rough-grinding setting value D1(*i*+1) based on the necessary time Tb(i) and the total required time Ta(i) in this manner, the timing for switching from the rough grinding to the first finish grinding can be appropriate timing in accordance with the property of the grinding wheel 15. That is, the times (Ta(i) and Ta(i+1)) for performing the first finish grinding result in necessary and sufficient lengths of time. As a result, the total time of the grinding decreases in the case of grinding a plurality of such workpieces W.

The finish grinding step of the present embodiment measures, as the shape deviation amount ΔD, the amount of change in the grinding resistance (sensor output difference ΔAj) detected by the AE sensor 16 (grinding resistance detector) while the workpiece W makes one rotation. The amount ΔAj of change in the grinding resistance corresponds to the shape deviation amount ΔD, the shape deviation amount ΔD can consequently be surely measured.

The finish grinding step in a modification of the embodiment measures, as the shape deviation amount ΔD, the amount of change in the outer diameter of the workpiece W detected by the sizing device 17 (shape detector) while the workpiece W makes one rotation. The amount of change in the outer diameter is the shape deviation amount ΔD itself. Accordingly, the shape deviation amount ΔD can be surely measured. The sizing device 17 is used for detecting whether the outer diameter D of the workpiece W has reached the setting value D1, D2, or D3 and is used as a shape detector for measuring the shape deviation amount ΔD. This configuration can reduce cost and simplify the machine.

The cylindrical grinding machine 1 that performs the above-described cylindrical grinding method includes the spindle device 12 that supports the cylindrical workpiece W such that the cylindrical workpiece W is rotatable, the grinding wheel 15 that grinds the workpiece W, the sizing device 17 or the AE sensor 16 that serves as a measuring device for measuring the shape deviation amount of the workpiece W from a perfect round shape in one rotation of the outer peripheral surface of the workpiece W, and the control device 18 that controls the cylindrical grinding machine 1 so as to perform the rough grinding until the diameter of the workpiece W reaches the rough-grinding setting value D1, and to perform the finish grinding subsequently to the rough grinding until the diameter of the workpiece W reaches the first finish setting value D2 while measuring the shape deviation amount ΔD of the workpiece W. The cylindrical grinding machine 1 can surely perform the cylindrical grinding method described above.

What is claimed is:

1. A cylindrical grinding method for grinding a cylindrical workpiece with a grinding wheel, the cylindrical grinding method comprising:

performing rough grinding until a diameter of the workpiece reaches a rough-grinding setting value;

performing finish grinding subsequent to the rough grinding until the diameter of the workpiece reaches a finish setting value while measuring a shape deviation amount of the workpiece from a perfect round shape in each rotation of a plurality of rotations of an outer peripheral surface of the workpiece;

comparing a time from a start time of the finish grinding to a time at which the shape deviation amount reaches a threshold value or smaller in the finish grinding and a total time of the finish grinding; and setting a rough-grinding setting value in a rough grinding at a next time for a next workpiece based on the comparison.

2. The cylindrical grinding method according to claim 1, wherein in the finish grinding, measuring, as the shape deviation amount, an amount of change in grinding resistance detected while the workpiece makes one rotation.

3. The cylindrical grinding method according to claim 1, wherein in the finish grinding, measuring, as the shape deviation amount, an amount of change in an outer diameter of the workpiece detected while the workpiece makes one rotation.

4. The cylindrical grinding method according to claim 1, further comprising performing spark-out subsequent to the finish grinding.

5. The cylindrical grinding method according to claim 1, wherein the time from the start time of the finish grinding to the time at which the shape deviation amount reaches the threshold value or smaller in the finish grinding and the total time of the finish grinding are discrete values.

6. The cylindrical grinding method according to claim 1, wherein when the time from the start time of the finish grinding to the time at which the shape deviation amount reaches the threshold value or smaller in the finish grinding is less than the total time of the finish grinding, the rough-grinding setting value in the rough grinding at the next time is set based upon a number of the plurality of rotations of the workpiece and the threshold value.

7. The cylindrical grinding method according to claim 6, wherein when the time from the start time of the finish grinding to the time at which the shape deviation amount reaches the threshold value or smaller in the finish grinding is not less than the total time of the finish grinding, the rough-grinding setting value in the rough grinding at the next time is set based upon a particular shape deviation amount measured during the finish grinding and a second threshold value.

8. The cylindrical grinding method according to claim 7, wherein when the particular shape deviation amount is less than or equal to the second threshold value, the rough-grinding setting value in the rough grinding at the next time is set at the rough grinding setting value.

9. The cylindrical grinding method according to claim 8, wherein when the particular shape deviation amount is not less than or equal to the second threshold value, the rough-grinding setting value in the rough grinding at the next time is set based upon the rough-grinding setting value and an amount of grinding done by performing the finish grinding by one rotation of the workpiece.

10. The cylindrical grinding method according to claim 7, wherein when the particular shape deviation amount is not less than or equal to the second threshold value, the rough-grinding setting value in the rough grinding at the next time is set based upon the rough-grinding setting value and an amount of grinding done by performing the finish grinding by one rotation of the workpiece.

11. The cylindrical grinding method according to claim 6, wherein the rough-grinding setting value in the rough grinding at the next time is set based upon an amount of grinding done by performing the finish grinding by one rotation of the workpiece.

12. The cylindrical grinding method according to claim 1, wherein when the time from the start time of the finish grinding to the time at which the shape deviation amount reaches the threshold value or smaller in the finish grinding is not less than the total time of the finish grinding, the rough-grinding setting value in the rough grinding at the next time is set based upon a particular shape deviation amount measured during the finish grinding and a second threshold value.

13. The cylindrical grinding method according to claim 12, wherein when the particular shape deviation amount is less than or equal to the second threshold value, the rough-grinding setting value in the rough grinding at the next time is set at the rough-grinding setting value.

14. The cylindrical grinding method according to claim 13, wherein when the particular shape deviation amount is not less than or equal to the second threshold value, the rough-grinding setting value in the rough grinding at the next time is set based upon the rough-grinding setting value and an amount of grinding done by performing the finish grinding by one rotation of the workpiece.

15. The cylindrical grinding method according to claim 12, wherein when the particular shape deviation amount is not less than or equal to the second threshold value, the rough-grinding setting value in the rough grinding at the next time is set based upon the rough-grinding setting value and an amount of grinding done by performing the finish grinding by one rotation of the workpiece.

16. The cylindrical grinding method according to claim 12, wherein the particular shape deviation amount is a shape deviation amount measured in a penultimate revolution of the workpiece during the finish grinding.

17. The cylindrical grinding method according to claim 12, wherein the second threshold value is greater than the threshold value.

18. A cylindrical grinding machine comprising:

a spindle device configured to support a cylindrical workpiece such that the cylindrical workpiece is rotatable;

a grinding wheel configured to grind the workpiece;

a sensor configured to measure a shape deviation amount of the workpiece from a perfect round shape in one rotation of an outer peripheral surface of the workpiece; and a controller configured to:

control the cylindrical grinding machine to perform rough grinding until a diameter of the workpiece reaches a rough-grinding setting value;

control the cylindrical grinding machine to perform finish grinding subsequent to the rough grinding until the diameter of the workpiece reaches a finish setting value while measuring the shape deviation amount of the workpiece;

compare a time from a start time of a previous finish grinding of a previous workpiece to a time at which the shape deviation amount reached a threshold value or smaller in the previous finish grinding and a total time of the previous finish grinding; and set the rough-grinding setting value based upon the comparison.

* * * * *